US012800240B2

(12) United States Patent
Li et al.

(10) Patent No.: US 12,800,240 B2
(45) Date of Patent: Nov. 17, 2026

(54) HEAT EXCHANGER

(71) Applicant: ZHEJIANG SANHUA AUTOMOTIVE COMPONENTS CO., LTD., Hangzhou (CN)

(72) Inventors: Hua Li, Hangzhou (CN); Shijie Shen, Hangzhou (CN)

(73) Assignee: ZHEJIANG SANHUA AUTOMOTIVE COMPONENTS CO., LTD., Hangzhou (CN)

( * ) Notice: Subject to any disclaimer, the term of this patent is extended or adjusted under 35 U.S.C. 154(b) by 198 days.

(21) Appl. No.: 18/275,363

(22) PCT Filed: Jan. 29, 2022

(86) PCT No.: PCT/CN2022/074881
§ 371 (c)(1),
(2) Date: Aug. 1, 2023

(87) PCT Pub. No.: WO2022/166863
PCT Pub. Date: Aug. 11, 2022

(65) Prior Publication Data

US 2024/0302102 A1 Sep. 12, 2024

(30) Foreign Application Priority Data

Feb. 8, 2021 (CN) ..... 202110180241.9

(51) Int. Cl.
*F28F 3/04* (2006.01)
*F28D 9/00* (2006.01)
(Continued)

(52) U.S. Cl.
CPC ..... *F28F 3/044* (2013.01); *F28D 9/005* (2013.01); *F28D 9/0075* (2013.01); *F28F 3/08* (2013.01); *F28F 21/084* (2013.01)

(58) Field of Classification Search
CPC ..... F28D 9/005; F28D 9/0043; F28F 3/044; F28F 3/042; F28F 3/04; B21C 37/158
See application file for complete search history.

(56) References Cited

U.S. PATENT DOCUMENTS 3,757,855 A * 9/1973 Kun ..... F28D 1/0391 29/890.039
5,186,250 A * 2/1993 Ouchi ..... F28F 3/042 165/177

(Continued)

FOREIGN PATENT DOCUMENTS

CN 101424490 A 5/2009
CN 103822521 A 5/2014

(Continued)

OTHER PUBLICATIONS

International Search Report for PCT/CN2022/074881 mailed Apr. 7, 2022, ISA/CN.

(Continued)

*Primary Examiner* — Jianying C Atkisson
*Assistant Examiner* — For K Ling
(74) *Attorney, Agent, or Firm* — Yue (Robert) Xu; Apex Attorneys at Law, LLP

(57) ABSTRACT

A heat exchanger includes a first plate and a second plate, the first plate includes a first base plate and first protrusions, and the second plate includes a second base plate and second protrusions, where the first base plate has a thickness of H1, the first protrusion has a height of h1, where 0.2≤H1/h1≤1; the second base plate has a thickness of H2, the second protrusion has a height of h2, where 0.2≤H2/h2≤1; the thickness of a first protrusion top portion is less than that of a first protrusion side portion; the thickness of a second protrusion top portion is less than that of a second protrusion (Continued)

side portion; and the first protrusion top portion is fixed to the second protrusion top portion.

20 Claims, 9 Drawing Sheets

(51) Int. Cl.
*F28F 3/08* (2006.01)
*F28F 21/08* (2006.01)

(56) References Cited

U.S. PATENT DOCUMENTS 5,271,151 A * 12/1993 Wallis ..... B21C 37/14 29/890.07
6,199,750 B1 * 3/2001 Kouno ..... F28D 1/035 228/183
6,799,630 B1 * 10/2004 Kato ..... B23K 1/0012 165/170
7,121,002 B1 * 10/2006 Roth ..... F28F 3/14 29/890.039
2006/0000588 A1 * 1/2006 Kang ..... F28F 3/044 165/170
2011/0180247 A1 * 7/2011 Persson ..... F28F 3/044 165/185
2016/0146543 A1 * 5/2016 Persson ..... F28D 9/0093 29/890.03
2020/0049413 A1 * 2/2020 Ojiro ..... F28F 3/086

FOREIGN PATENT DOCUMENTS

CN 205298862 U 6/2016
CN 210386956 U 4/2020
CN 211903861 U 11/2020
CN 212362927 U 1/2021
CN 212378568 U 1/2021
EP 0907062 A1 * 4/1999 ..... F28D 1/0391
EP 3115732 A1 1/2017
JP 2000146477 A * 5/2000 ..... F28D 1/0333
JP 2000283682 A 10/2000
KR 2006031261 A * 4/2006 ..... B60H 1/08
WO 2018020223 A1 2/2018
WO WO-2019115942 A1 * 6/2019 ..... F28F 3/044

OTHER PUBLICATIONS

European Search Report issued on Nov. 26, 2024 for the European counterpart application No. 22749142.0.

* cited by examiner

HEAT EXCHANGER

This application claims the priority of the Chinese Patent Application No. 202110180241.9, titled "HEAT EXCHANGER", filed on Feb. 8, 2021 with the China National Intellectual Property Administration, which is incorporated herein by reference in its entirety.

FIELD

The present application relates to the technical field of heat exchange, and in particular to a heat exchanger.

BACKGROUND

Multiple channels are formed in a heat exchanger mainly by partition of stacked plates, and different media in adjacent channels exchange heat during circulation. In order to reduce the weight of the heat exchanger, aluminum alloy plates generally having a thickness of about 0.5 mm are usually used as the plates, and recesses or protrusions with different shapes are usually processed on the surface of the plate to improve the heat exchange performance. In order to further reduce the weight and cost of the heat exchanger, thinner and thinner plates, even less than 0.4 mm, have been developed in related industries. When recesses or protrusions are processed on an ultra-thin plate, a large material thinning rate, usually around 20% or even higher, exists locally in the process of pulling up the plate with a flat structure, which will affect the strength of the heat exchanger.

SUMMARY

The objective of the present application is to provide a heat exchanger, to ensure the strength of the heat exchanger.

A heat exchanger is provided according to an embodiment of the present application. The heat exchanger includes a first plate and a second plate that are arranged in a stacked manner, where the first plate includes a first base plate and first protrusions protruding from the first base plate, and the second plate includes a second base plate and second protrusions protruding from the second base plate.

Each of the first protrusions includes a first protrusion top portion and a first protrusion side portion arranged around the first protrusion top portion, where the first protrusion top portion has a thickness less than that of the first protrusion side portion. Each of the second protrusions includes a second protrusion top portion and a second protrusion side portion arranged around the second protrusion top portion. The second protrusion top portion has a thickness less than that of the second protrusion side portion, and the first protrusion top portion is fixedly connected to the second protrusion top portion.

The first base plate has a thickness of H1, the first protrusion has a height of h1, where $0.2 \leq H1/h1 \leq 1$; and/or the second base plate has a thickness of H2, the second protrusion has a height of h2, where $0.2 \leq H2/h2 \leq 1$.

The first plate according to the present application includes the first protrusions, each of the first protrusions includes the first protrusion top portion and the first protrusion side portion arranged around the first protrusion top portion. Multiple second protrusions are formed on the second plate, each of the second protrusions includes the second protrusion top portion and the second protrusion side portion arranged around the second protrusion. The thickness H1 of the first base plate and the height h1 of the first protrusion are set to satisfy $0.2 \leq H1/h1 \leq 1$, and/or, the thickness H2 of the second base plate and the height h2 of the second protrusion are set to satisfy $0.2 \leq H2/h2 \leq 1$. By setting the relationship between the thickness of the first plate and/or second plate and the height of the first protrusions and/or the second protrusions, the deformation amount of the thickness of the protrusion top portion and the thickness of the protrusion side portion can be adjusted, so that a maximum thinned region of the first plate and/or second plate is distributed at the protrusion top portion, and the range of the maximum thinned region of the first plate and/or second plate is reduced, so as to ensure that the thickness around the protrusion top is enough. The thickness of the first protrusion side portion is greater than that of the first protrusion top portion, the thickness of the second protrusion side portion is greater than that of the second protrusion top portion, and the first protrusion top portion having a large thinning amount is fixed to the second protrusion top portion having a large thinning amount, and the weakest regions of the first plate and the second plate are superimposed together to increase the thickness, thereby facilitating the improvement of the strength of the heat exchanger.

DETAILED DESCRIPTION OF THE EMBODIMENTS

Figure 1:
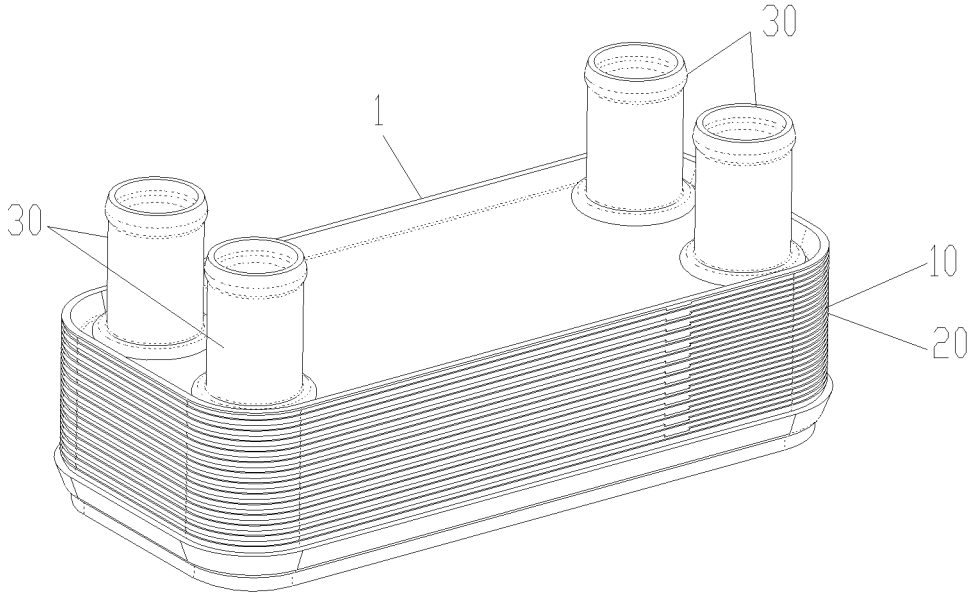
FIG. 1 is a schematic perspective structural view of a heat exchanger according to the present application.
Figure 2:
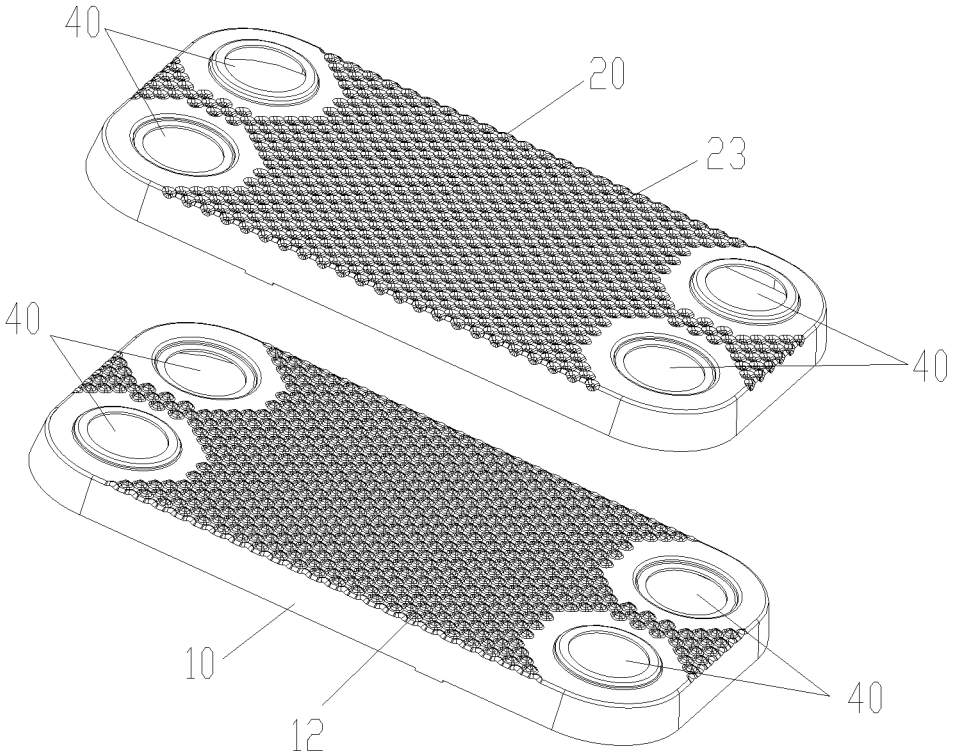
FIG. 2 is a schematic exploded structural view of a first plate and a second plate of the heat exchanger according to the present application.

With reference to FIG. 1 to FIG. 17, a heat exchanger 1 is provided according to the present application. The heat exchanger 1 at least includes a first plate 10 and a second plate 20 that are arranged in a stacked manner. The first plate 10 and the second plate 20 each is an aluminum alloy plate. The heat exchanger is provided with a first fluid channel 16 which is located between the first plate 10 and the second plate 20 and is used for the first fluid to flow through. The first plate 10 and the second plate 20 may be provided with multiple corner holes 40 for the first fluid to flow into or out of the first fluid channel 16. The heat exchanger 1 may be provided with a connecting pipe 30 to communicate with the corner holes 40, and the first plate 10 and the second plate 20 may be fixed by welding or the like. The heat exchanger may be further provided with a second fluid channel 26. The second fluid channel 26 is arranged adjacent to the first fluid channel 16. The second fluid channel 26 may be located on the other side of the first plate 10 or the second plate 20, and is used for a second fluid to flow through. The first fluid and the second fluid exchange heat in the heat exchanger. Specifically, the second fluid channels 26 and the first fluid channels 16 may be alternately arranged. A third fluid channel for another fluid to flow through may be further arranged.

Of course, alternatively, the first plate 10 and the second plate 20 may be made of other materials such as stainless steel plates. With the aluminum alloy plates, the weight and the cost of the heat exchanger 1 can be reduced.

As shown in FIG. 2 to FIG. 9, the first plate 10 includes a first base plate 11 and multiple first protrusions 12 protruding toward the second plate 20. A first recess 13 is formed at one side, facing away from the second plate 20, of each of the first protrusions 12, and the first recess 13 is recessed relative to the first base plate. The second plate 20 includes a second base plate 21 and multiple second protrusions 22 protruding toward the first plate 10. A second recess 23 is formed at one side, facing away from the first plate 10, of each of the second protrusions 22, and the second recess 23 is recessed relative to the first base plate. The first protrusion 12 includes a first protrusion top portion 121 and a first protrusion side portion 122 arranged around the first protrusion top portion 121. The second protrusion 22 includes a second protrusion top portion 221 and a second protrusion side portion 222 arranged around the second protrusion top portion 221, and the first protrusion top portion 121 is fixed to the second protrusion top portion 221.

It should be noted that the first protrusion 12 and the second protrusion 22 here are at least partial protrusions fixed to each other in the first plate 10 and the second plate 20. The first plate 10 may be provided with other protrusions in addition to the first protrusion 12, and the second plate 20 may be provided with other protrusions in addition to the second protrusion 22.

The first base plate 11 has a thickness of H1, the first protrusion 12 has a height of h1, the second base plate 21 has a thickness of H2, and the second protrusion 22 has a height of h2. The thickness H1 of the first base plate 11 and the height h1 of the first protrusion 12 are set to satisfy $0.2 \leq H1/h1 \leq 1$, and the thickness H2 of the second base plate 21 and the height h2 of the second protrusion 22 are set to satisfy $0.2 \leq H2/h2 \leq 1$. The thickness of the first base plate 11 and the second base plate 21 is the thickness of the raw materials before the protrusions are processed onto the first plate 10 and the second plate 20, for example, the thickness of the plates before the protrusions are stamped thereon. By setting the relationship between the thickness of the base plates and the height of the protrusions, the deformation amount of the thickness of the protrusion top portion and the thickness of the protrusion side portion can be adjusted, so that a maximum thinned region of the first plate 10 and/or the second plate 20 is distributed at the protrusion top portion. The maximum thinned region of the first plate 10 and/or the second plate 20 is reduced, so as to ensure the thickness around the protrusion top portion is enough. The thickness of the first protrusion top portion 121 is less than that of the first protrusion side portion 122, and the thickness of the second protrusion top portion 221 is less than that of the second protrusion side portion 222. When the first plate and/or the second plate is made of aluminum alloy plate, since aluminum alloy has better ductility, by controlling the above parameters, the distribution of the maximum thinned region of the first plate and/or the second plate can be better controlled. Moreover, the first protrusion top portion 121 is fixed to the second protrusion top portion 221, the distribution of the maximum thinned region of the first plate 10 and the second plate 20 is controlled, and the weakest regions of the first plate 10 and the second plate 20 are superimposed together to increase the thickness, thereby solving the problems of strength and corrosion resistance of the heat exchanger caused by the maximum thinned region of the first plate and/or the second plate. The heat exchanger with this structure is suitable for the thinner first plate and/or the second plate to reduce the weight and cost of the heat exchanger.

Furthermore, each of the first protrusions 12 on the first plate 10 includes a first protrusion top portion 121 and a first protrusion side portion 122 arranged around the first protrusion top portion 121, and each of the second protrusions 22 on the second plate 20 includes a second protrusion top portion 221 and a second protrusion side portion 222 arranged around the second protrusion top portion 221. The first recess 13 and the second recess 23 has recessed structures, so that the maximum thinned region of the first plate 10 and the second plate 20 are distributed on the first protrusion top portion 121 and the second protrusion top portion 221 in a point-like structure. A range of a single maximum thinned region of the first plate 10 and the second plate 20 can be reduced, so that the maximum thinned region of the first plate 10 and the maximum thinned region of the second plate 20 can be overlapped and reliably covered by the assembly of the first plate 10 and the second plate 20, thereby improving the reliability of the heat exchanger.

It can be understood that in some specific embodiments, only the thickness H1 of the first base plate 11 of the first plate 10 and the height h1 of the first protrusion 12 meet the above relationship, or only the thickness H2 of the second base plate 21 of the second plate 20 and the height h2 of the second protrusion 22 meet the above relationship. At least the distribution of the maximum thinned region of one of the two plates that are abutted to each other is reduced, and the coverage of the enlarged thinned region of the other plate is focused on in assembly, thereby improving the reliability of the heat exchanger.

As shown in FIG. 5 to FIG. 10, the first protrusion top portion 121 and the second protrusion top portion 221 are welded to form a fixed region 50, where the fixed region 50 refers to a region where the first protrusion 12 and the second protrusion 22 are fixed to each other. The fixed region 50 includes a region filled with solder. The first protrusion top portion 121 refers to a region between the highest point of the first protrusion 12 and an outer edge of the fixed region 50, and the second protrusion top portion 221 refers to a region between the highest point of the second protrusion 22 and the outer edge of the fixed region 50. The first protrusion side portion 122 refers to a region between the outer edge of the fixed region and the first base plate 11, excluding a chamfered region where the first protrusion 12 connects with the first base plate 11. The second protrusion side portion 222 refers to a region between the outer edge of the fixed region 50 and the second base plate 21, excluding a chamfered region where the second protrusion 22 connects with the second base plate 21.

Figure 10:
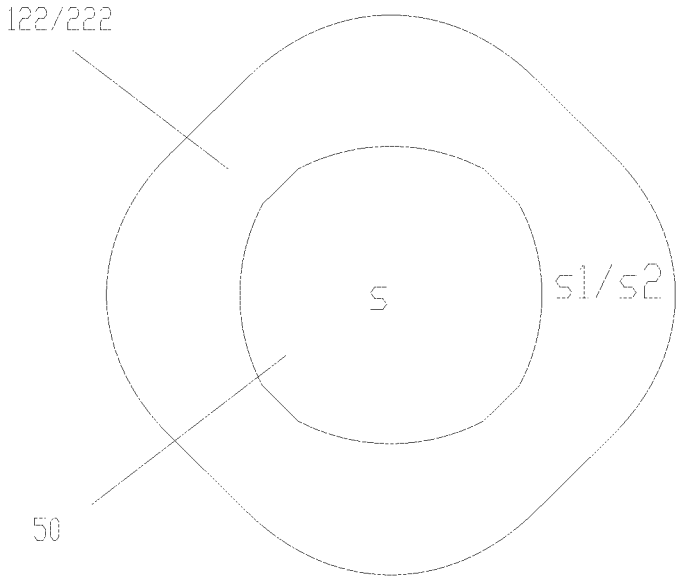
FIG. 10 is a schematic view showing projection of a first protrusion/second protrusion of the heat exchanger according to the present application in a plane where a first base plate/second base plate is located.
Figure 11:
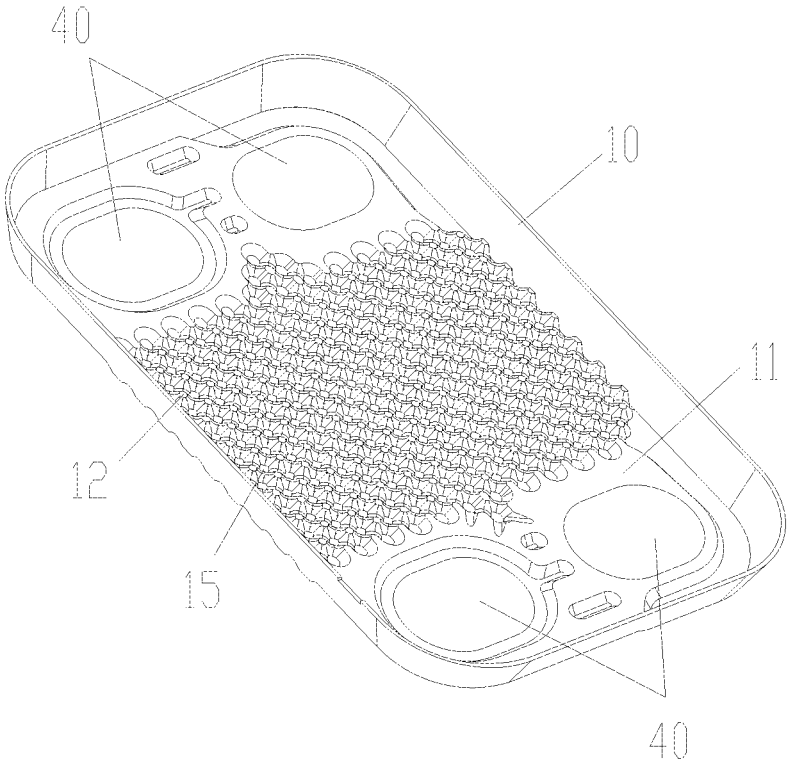
FIG. 11 is an schematic structural view of the first plate of the heat exchanger according to another embodiment of the present application.

As shown in FIG. 10, an orthographic projection area of the fixed region 50 on a plane where the first base plate 11 is located is represented as "s", and an orthographic projection area of the first protrusion 12 on the plane where the first base plate 11 is located is represented as "s1". That is, the whole area of the structure shown in FIG. 10 is represented as "s1", and the orthographic projection area of the second protrusion 22 on a plane where the second base plate 21 is located is represented as "s2", where the first protrusion 12 and the second protrusion 22 may be the same, that is, s1 and s2 may be equal. The orthographic projection area s of the fixed region 50, at which the first protrusion top portion 121 and the second protrusion top portion 221 are fixed to each other, on the plane where the first base plate 11 is located, the orthographic projection area s1 of the first protrusion 12 on the plane where the first base plate 11 is located and the orthographic projection area s2 of the second protrusion 22 on the plane where the second base plate 21 is located are set to meet the following requirements: $0.2 \le s/s1 \le 0.8$, $0.2 \le s/s2 \le 0.8$. It can be ensured that the first protrusion top portion 121 and the second protrusion top portion 221 have enough fixed region 50 to cover the maximum thinned regions of the first plate 10 and the second plate 20, to ensure the strength and corrosion resistance of the heat exchanger. Moreover, the relationships between the orthographic projection area s of the fixed region 50 on the plane where the first base plate 11 is located and the orthographic projection areas of the first protrusion 12 on the first base plate 11 and the second protrusion 22 on the second base plate 21 are set to balance the mounting reliability of the first plate 10 and the second plate 20 and the heat exchange area between the first fluid and the first protrusion 12 and the second protrusion 12, thereby improving the heat exchange performance of the heat exchanger while ensuring the mounting strength of the heat exchanger.

In addition, the height h1 of the first protrusion 12, the orthographic projection area s of the fixed region 50, at which the first protrusion 12 and the second protrusion 22 are fixed to each other, on the plane where the first base plate is located and the orthographic projection area s1 of the first protrusion 12 on the plane where the first base plate 11 is located are set to meet the requirement of $2.5 \le (s+s1)/h1 \le 8$, and the height h2 of the second protrusion 22, the orthographic projection area s of the fixed regions 50 of the first protrusion 12 and the second protrusion 22 on the plane where the first base plate 11 is located and the orthographic projection area s2 of the second protrusion 22 on the plane where the second base plate 21 is located are set to meet the requirement of $2.5 \le (s+s2)/h2 \le 8$, so as to better control the maximum thinned amount of the first plate 10 and the second plate 20 and the area of a single maximum thinned region. It is ensured that the maximum thinned regions of the first plate 10 and the second plate 20 can abut against each other to increase the thickness, which solves the problems of strength and corrosion resistance caused by too thin plates through assembly, and is convenient to control the thickness of the first protrusion side portion 122 and the second protrusion side portion 222, to ensure that the first protrusion side portion 122 and the second protrusion side portion 222 have sufficient thickness. In addition, it is facilitated to adjust the height of the first protrusion 12 and the orthographic projection area of the first protrusion 12 on the plane where the first base plate 11 is located, or adjust the height of the second protrusion 22 and the orthographic projection area of the second protrusion 22 on the plane where the second base plate 21 is located according to the requirements of pressure drop and heat transfer performance and the like.

Figure 5:
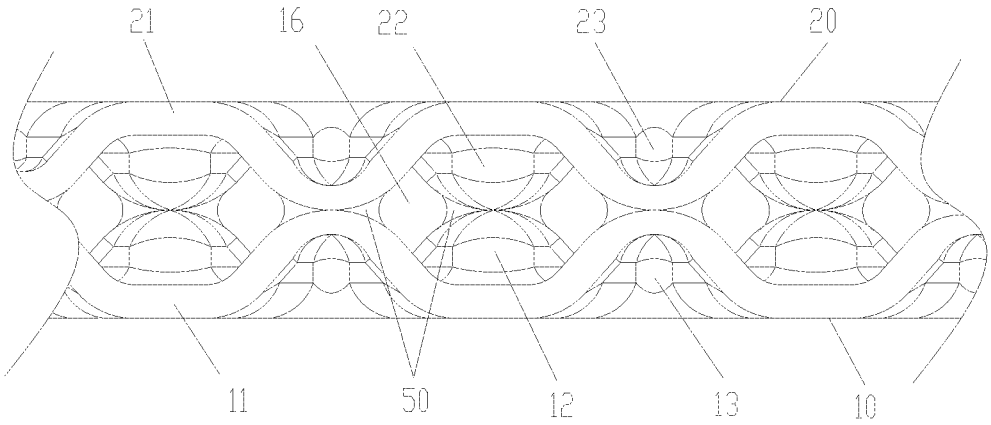
FIG. 5 is a schematic view showing a mounting structure of the first plate and the second plate of the heat exchanger according to the present application.

In some specific embodiments, as shown in FIG. 5, the first plate 10 and the second plate 20 may be of symmetrical structures, i.e., the first projection 12 of the first plate 10 and the second projection 22 of the second plate 20 have exactly the same shape, size and distribution. The second plate 20 may be formed by flipping the first plate 10. The orthographic projection area s1 of the first projection 12 on the plane where the first base plate 11 is located equals to the orthographic projection area s2 of the second projection 22 in the plane where the second base plate 21 is located. Of course, the first plate 10 and the second plate 20 may be of different structures, for example, the first projection 12 and the second projection 22 may have different heights. Of course, the first plate and the second plate may be of other different structures, for example, the orthographic projection area s1 of the first recess 13 on the plane where the first base plate 11 is located is not equal to the orthographic projection area s2 of the second recess 23 on the plane where the second base plate 21 is located, or the first plate 10 and the second plate 20 are provided with protrusions of other structures in addition to the first protrusion 12 and the second protrusion 22.

As shown in FIG. 11 to FIG. 16, protrusions are provided on two sides of the first plate 10 and the second plate 20. A first recess 13 is formed at one side, facing away from the second plate 20, of each of the first protrusions 12, and a second recess 23 is formed at one side, facing away from the first plate 10, of each of the second protrusions 22. The first plate 10 further includes multiple third protrusions 14 protruding away from the second plate 20. A third recess 15 is formed at one side, facing the second plate 20, of each of the third protrusions 14. The second plate 20 further includes multiple fourth protrusions 24 protruding away from the first plate 10. A fourth recess 25 is formed at one side, facing the first plate 10, of each of the fourth protrusions 24. In the length direction of the heat exchanger, the first protrusions 12 and the third recesses 15 are alternately arranged, the second protrusions 22 and the fourth recesses 25 are alternately arranged, the first protrusions 12 are opposite to the second protrusions 22, and the third recesses 15 are opposite to the fourth recesses 25. The first fluid bypasses the fixed region at which the first protrusion 12 and the second protrusion 22 are fixed to each other, and flows from two sides of the first protrusion 12 and the second protrusion 22 to a region between the third recess 15 and fourth recess 25. Since a flow area between the third recess 15 and the fourth recess 25 is larger than that of the two sides of the first protrusion 12 and the second protrusion 22, with the above structure, the convergent-divergent flow of the first fluid is enhanced, thereby further improving the heat exchange effect of the first fluid.

Figure 15:
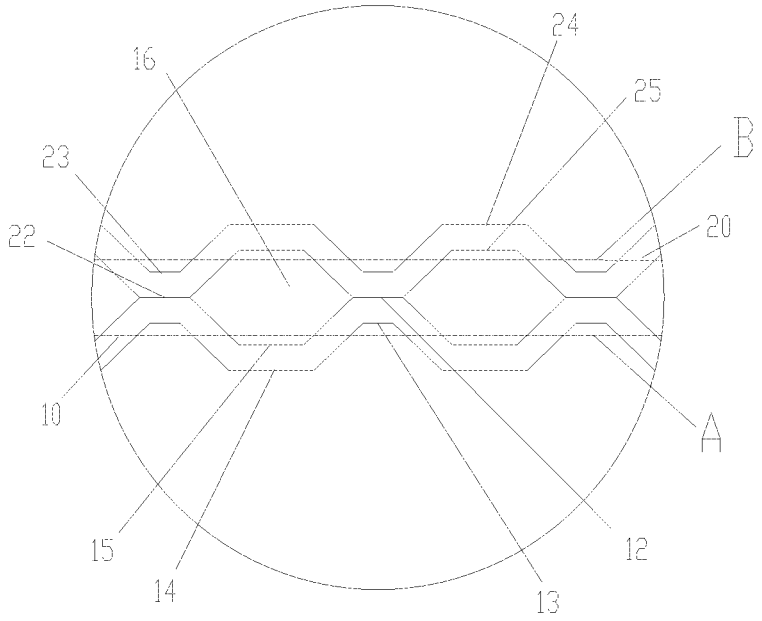
FIG. 15 is a partial enlarged schematic view showing still another mounting structure of the first plate and the second plate of the heat exchanger according to the present application.

As shown in FIG. 15, the plane where the dotted line A is located is the plane where the first base plate 11 is located, and the plane where the dotted line B is located is the plane where the second base plate 21 is located. The first protrusion 12 protrudes toward one side of the first base plate 11, and the third protrusion 14 protrudes toward the other side of the first base plate 11. The second protrusion 22 protrudes toward one side of the second base plate 21, and the fourth protrusion 14 protrudes toward the other side of the second base plate 21. The first protrusion 12 and the third protrusion 14 shown in the figure have the same height, and the second protrusion 22 and the fourth protrusion 24 have the same height. Of course, the first protrusion 12 may have a different height from that of the third protrusion 14, and the second protrusion 22 may have a different height from that of the fourth protrusion 24.

In some specific embodiments, the first plate 10 is provided with multiple third protrusions 14 protruding away from the second plate 20, the second plate 20 is provided with multiple fourth protrusions 24 protruding away from the first plate 10, and multiple first plates 10 and second plates 20 may be alternately stacked to form alternately arranged first fluid channels 16 and second fluid channels 26 to simplify the structure of the plates. By stacking the first plate 10 and the second plate 20 on each other, the maximum thinned regions between the first plate 10 and the second plate 20 are arranged opposite to each other, and the maximum thinned region of the first plate 10 is superimposed on the maximum thinned region of the second plate 20 to increase the thickness. The maximum thinned region is transferred into the region with maximum thickness. The problems of strength and corrosion resistance caused by the maximum thinned region of the plates are solved through the structural arrangement of the heat exchanger. Of course, the first plate 10 and the second plate 20 may be arranged into a centrosymmetric structure, and the second plate may be obtained by rotating the first plate 180 degrees, which further simplifies the structure of the heat exchanger and facilitates processing and assembly. In addition, the shape and height of the first protrusion 12 and the third protrusion 14 may be the same or different, and the shape and height of the second protrusion 22 and the fourth protrusion 24 may be the same or different.

Figure 12:
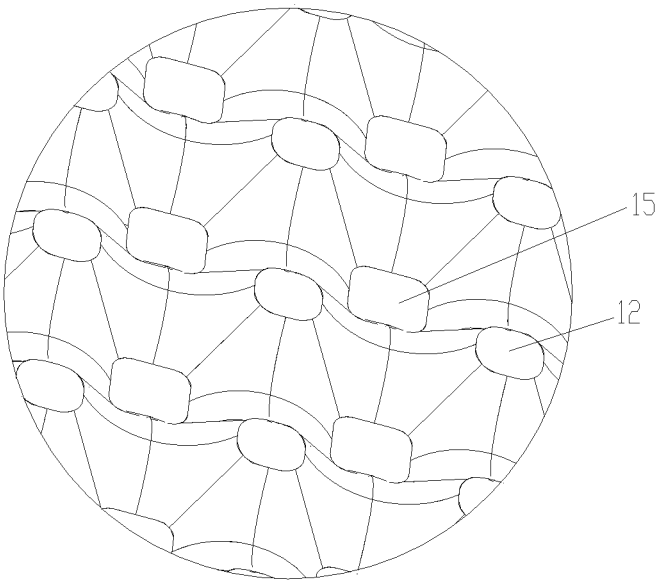
FIG. 12 is a partial enlarged structural view of the first plate of the heat exchanger according to another embodiment of the present application.
Figure 13:
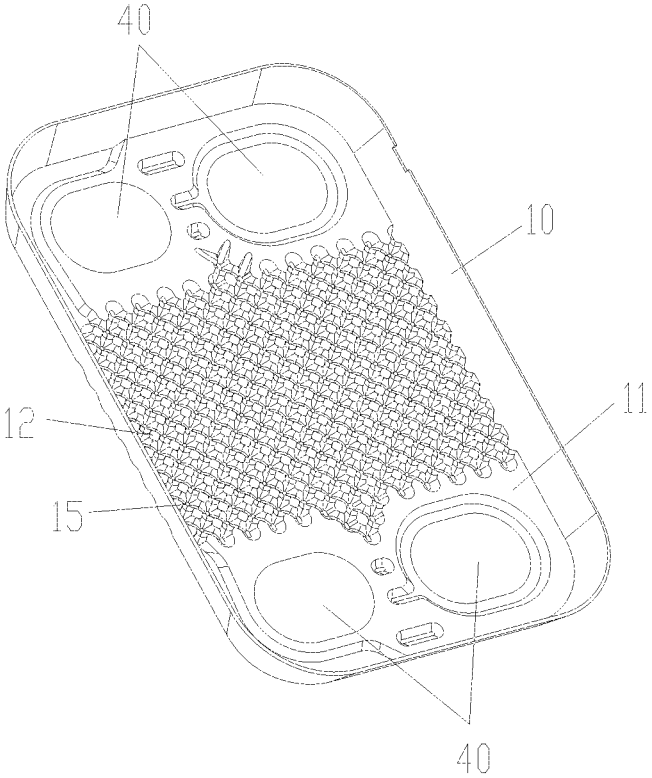
FIG. 13 is an schematic structural view of the first plate of the heat exchanger according to yet another embodiment of the present application.
Figure 14:
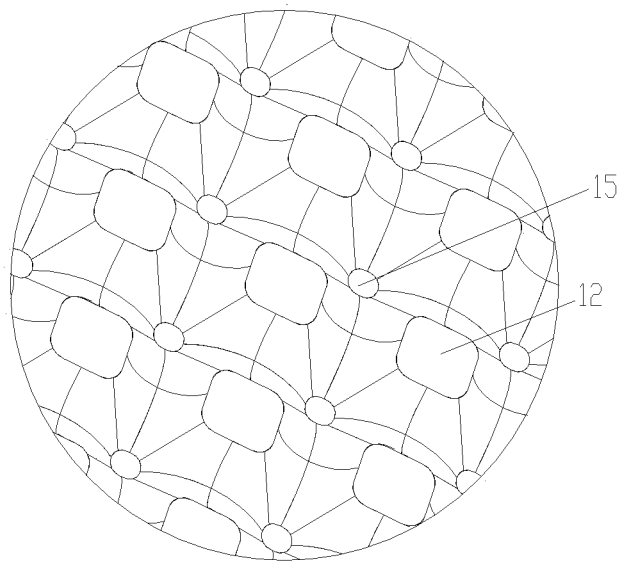
FIG. 14 is a partial enlarged structural view of the first plate of the heat exchanger according to yet another embodiment of the present application.
Figure 16:
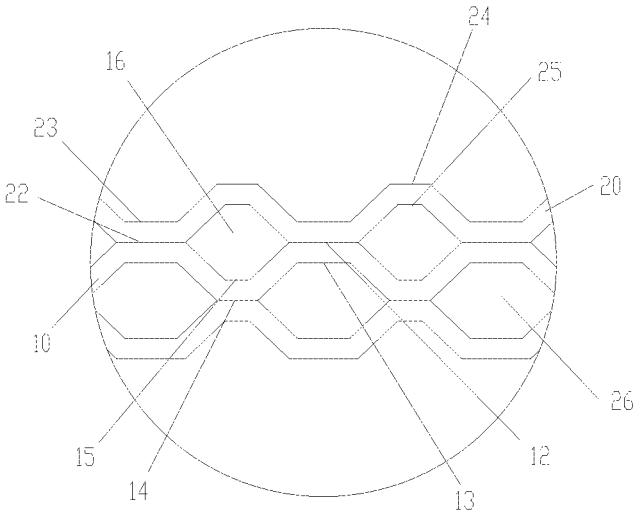
FIG. 16 is a partial enlarged schematic view showing yet another mounting structure of the first plate and the second plate of the heat exchanger according to the present application.

As shown in FIG. 12, the top portion of the first protrusion 12 and the bottom portion of the third recess 15 are both of a planar structure, and the area of the top portion of the first protrusion 12 is smaller than that of the bottom portion of the third recess 15. As shown in FIG. 14, the top portion of the first protrusion 12 and the bottom portion of the third recess 15 are both of a planar structure, and the area of the top portion of the first protrusion 12 is larger than that of the bottom portion of the third recess 15. As shown in FIG. 16, the first protrusion 12 and the second protrusion 22 are of different structures, which enables the first fluid channel 16 and the second fluid channel 26 are of asymmetric structures, so that the flow areas of the first fluid channel 16 and the second fluid channel 26 may be easily adjusted according to the characteristics of the first fluid and the second fluid, thereby facilitating improving the heat exchange effect of the heat exchanger.

Figure 3:
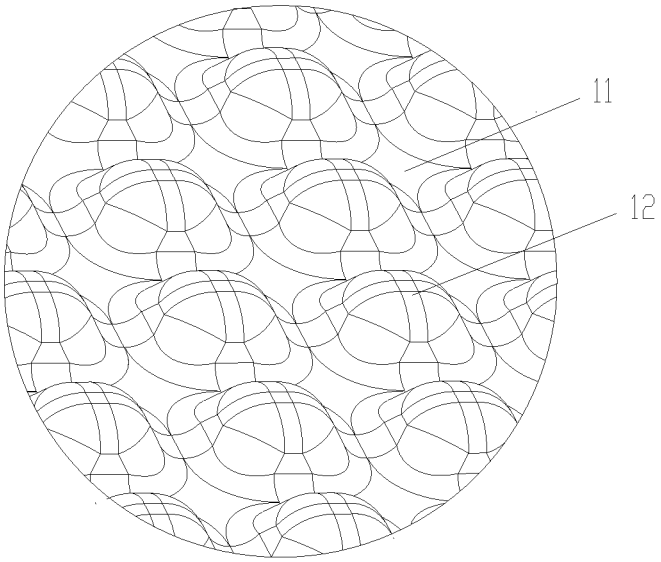
FIG. 3 is a partial enlarged structural view of the first plate of the heat exchanger according to the present application.
Figure 4:
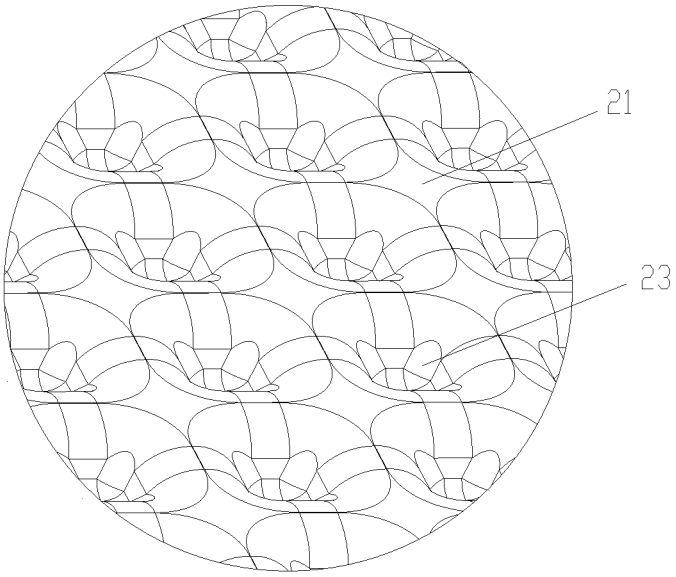
FIG. 4 is a partial enlarged structural view of the second plate of the heat exchanger according to the present application.

As shown in FIG. 3 and FIG. 4, the region surrounded by multiple first protrusions 12 may be of a planar structure, and the region surrounded by multiple second protrusions 22 may be of a planar structure. That is, the third protrusion 14 and the fourth protrusion 24 mentioned above are not provided, which allows one side, facing away from the second plate 20, of the first plate 10 is of a flat structure, and/or one side, facing away from the first plate 10, of the second plate 20 is of a flat structure. The flat structure refers to the structure only provided with recesses but without protrusions. In some embodiments, fin plates or plates with other structures may be installed on one side, facing away from the second plate 20, of the first plate 10, and/or on one side, facing away from the first plate 10, of the second plate 20.

Figure 17:
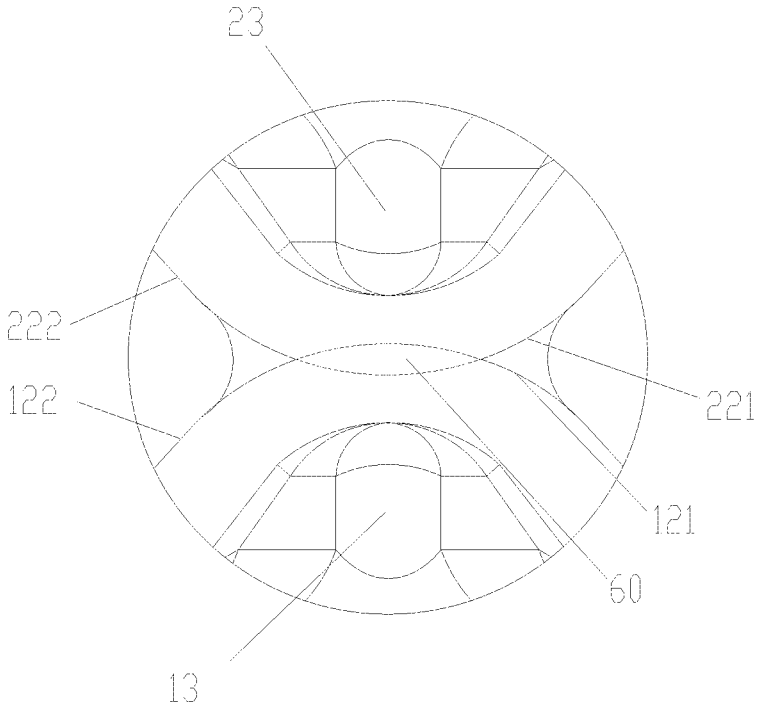
FIG. 17 is a schematic structural view of the first protrusion and the second protrusion, over-embedded in the welding process, of the heat exchanger according to the present application.

As shown in FIG. 5 to FIG. 10, a composite layer is provided at one side, facing the second protrusion 22, of the first plate 10 and a composite layer is provided at one side, facing the first protrusion 12, of the second plate 20. The composite layers of the first protrusion top portion 121 and the second protrusion top portion 221 form a fixed region 50 by welding. For the composite layer between the first protrusion top portion 121 and the second protrusion top portion 221, as shown in FIG. 17, in the welding process, the composite layer closer to the center of the first protrusion top portion 121 is distributed around the first protrusion top portion 121 by the first protrusion top portion 121 and the second protrusion top portion 221 being over-embedded, that is, by the first protrusion top portion 121 and the second protrusion top portion 221 being squeezed to form an over-embedded area 60 therebetween. In this way, for the composite layer located in the fixed region 50, a thickness of part of the composite layer away from a center of the fixed region 50 is greater than that of another part of the composite layer closer to the center of the fixed region 50, that is, the thickness of the composite layer in the fixed region 50 increases outward from the center of the fixed region 50, which not only increases the area of the fixed region 50 between the first protrusion top portion 121 and the second protrusion top portion 221, but also fully covers the maximum thinned region of the first plate 10 and the second plate 20. Moreover, the composite layers at the centers of the first protrusion top portion 121 and the second protrusion top portion 221 are adsorbed around the first protrusion top portion 121 and the second protrusion top portion 221, and the region between an periphery region of the first protrusion top portion 121 and an periphery region of the second protrusion top portion 221 is filled with the composite layers, so that the contact region between the first protrusion top portion 121 and the second protrusion top portion 221 is surrounded. It not only enhances the reliability of fixing between the first protrusion top portion 121 and the second protrusion top portion 221, but also increases the coverage range of the first protrusion top portion 121 and the second protrusion top portion 221, thereby further improving the strength and corrosion resistance of the heat exchanger. The first plate 10 and the second plate 20 may be provided with composite layers on both sides.

Figure 7:
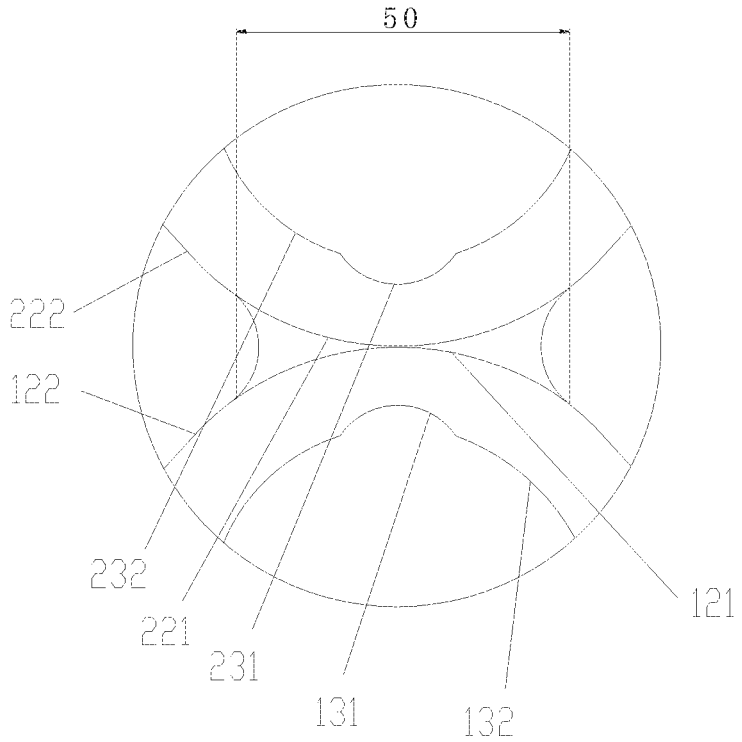
FIG. 7 is a partial enlarged schematic view showing another mounting structure of the first plate and the second plate of the heat exchanger according to the present application.

In some embodiments, as shown in FIG. 7, a first recess bottom portion 131 and a first recess side portion 132 arranged around the first recess bottom portion 131 are provided at one side, facing away from the second plate 20, of the first protrusion 12. A second recess bottom portion 231 and a second recess side portion 232 arranged around the second recess bottom portion 231 are provided at one side, facing away from the first plate 10, of the second protrusion 22. The curvature radius of the first recess bottom portion 131 is smaller than that of the first recess side portion 132, and the curvature radius of the second recess bottom portion 231 is less than that of the second recess side portion 232. Since the curvature radius of the first recess bottom portion 131 is smaller than that of the first recess side portion 132, the material of the first recess bottom portion 131 is promoted to flow around, the thickness difference between the first recess bottom portion 131 and the first recess side portion 132 is increased, so that the thickness of the first recess bottom portion 131 become smaller. That is, the maximum thinned amount of the maximum thinned region of the first plate 10 is increased to reduce the range of the maximum thinned region of the first plate 10. Similarly, the curvature radius of the second recess bottom portion 231 is smaller than that of the second recess side portion 232, the material of the second recess bottom portion 231 is promoted to flow around, the thickness difference between the second recess bottom portion 231 and the second recess side portion 232 is increased, so that the thickness of the second recess bottom portion 231 become smaller. That is, the maximum thinned amount of the maximum thinned region of the second plate 20 is increased to reduce the range of the maximum thinned region of the second plate 20. During the assembly process, with the first protrusion top portion 121 and the second protrusion top portion 221 being welded, the contact area between the first protrusion top portion 121 and the second protrusion top portion 221 is ensured to be sufficient to cover the maximum thinned regions of the first plate 10 and the second plate 20, and the maximum thinned regions of the first plate 10 and the second plate 20 are ensured to overlap each other to increase the thickness, thereby improving the strength and corrosion resistance of the heat exchanger.

It should be noted that in some specific embodiments, it is possible to set only the curvature radius of the first recess bottom portion 131 to be less than that of the first recess side portion 132, or to set only the curvature radius of the second recess bottom portion 231 to be less than that of the second recess side portion 232.

Figure 8:
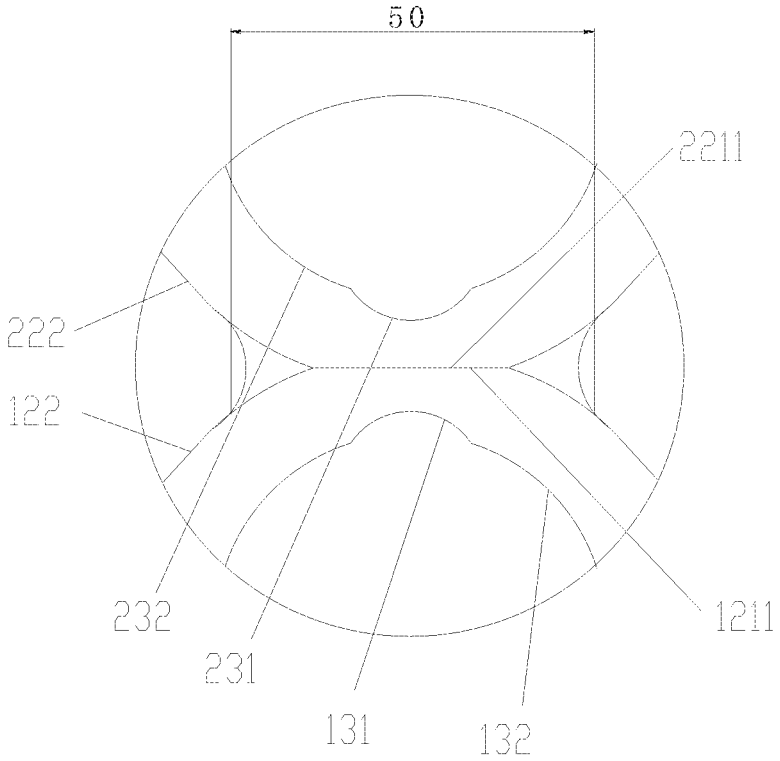
FIG. 8 is a partial enlarged schematic view showing yet another mounting structure of the first plate and the second plate of the heat exchanger according to the present application.

As shown in FIG. 8, the first protrusion top portion 121 is provided with a first planar portion 1211 facing the second protrusion 22, and the second protrusion top portion 221 is provided with a second planar portion 2211 facing the first protrusion 12, and the first planar portion 1211 is in contact with the second planar portion 2211. By configuring the central parts of the first protrusion top portion 121 and the second protrusion top portion 221 as planar structures, it can be ensured that the maximum thinned regions of the first plate 10 and the second plate 20 are located in the planar structures of the first protrusion top portion 121 and the second protrusion top portion 221. The first planar portion 1211 is contacted with the second planar portion 2211 to ensure that the maximum thinned regions of the first plate 10 and the second plate 20 overlap with each other, so as to avoid ineffectively covering the maximum thinned regions of the first plate 10 and the second plate 20 in the assembly process, which is not only convenient for installation, but also convenient for controlling the welding area between the first protrusion top portion 121 and the second protrusion top portion 221 to ensure the reliability of the installation and improve the strength and corrosion resistance of the heat exchanger. In addition, the first protrusion top portion 121 is provided with a first planar portion 1211, and the second protrusion top portion 221 is provided with a second planar portion 2211. The first protrusion top portion 121 and the second protrusion top portion 221 with the planar structures further increase the maximum thinned amount of the first plate 10 and the second plate 20, and promotes the material to flow around the first protrusion top portion 121 and the second protrusion top portion 221, thereby reducing the range of the maximum thinned regions of the first plate 10 and the second plate 20, so as to ensure that the maximum thinned regions of the first plate 10 and the second plate 20 can be effectively covered.

It should be noted that in some specific embodiments, it is possible to set only the first protrusion top portion 121 or only the second protrusion top portion 221 to be a planar structure, and the protrusion top portion with the planar structure is matched with the protrusion top portion of the arc structure, so that the gap around the first protrusion top portion 121 and the second protrusion top portion 221 is narrowed, which is convenient for the composite layer to cover more areas, thus ensuring that the maximum thinned regions of the first plate 10 and the second plate 20 is completely covered.

In some specific embodiments, the first protrusion top portion 121 may be configured as a planar structure, and the curvature radius of the second recess bottom portion 231 is smaller than that of the second recess side portion 232, or the second protrusion top portion 221 is of a planar structure, and the curvature radius of the first recess bottom portion 131 is smaller than that of the first recess side portion 132. Or the first protrusion top portion 121 is of a planar structure, and the curvature radius of the first recess bottom portion 131 is smaller than that of the first recess side portion 132, or the second protrusion top portion 221 is of a planar structure, and the curvature radius of the second recess bottom portion 231 is smaller than that of the second recess side portion 232.

Figure 9:
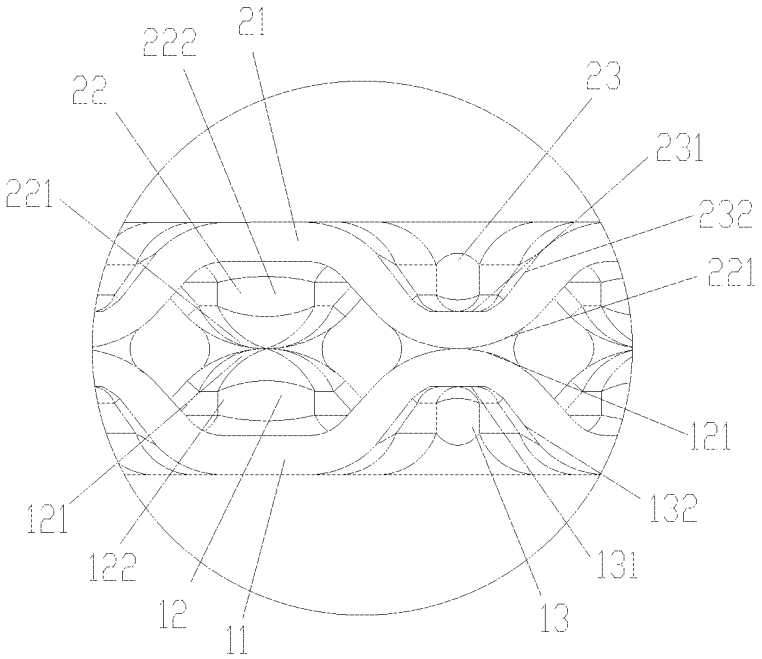
FIG. 9 is a partial enlarged schematic view showing still another mounting structure of the first plate and the second plate of the heat exchanger according to the present application.

As shown in FIG. 9, the first protrusion top portion 121 is of an arc surface structure, the second protrusion top portion 221 is of an arc surface structure, and the first protrusion top portion 121 is fixed to the second protrusion top portion 221. A first recess bottom portion 131 and a first recess side portion 132 arranged around the first recess bottom portion 131 are provided at one side, facing away from the second plate 20, of the first protrusion 12. A second recess bottom portion 231 and a second recess side portion 232 arranged around the second recess bottom portion 231 are provided at one side, facing away from the first plate 10, of the second protrusion 22. The first recess bottom portion 131 is of a planar structure, and the second recess bottom portion 231 is of a planar structure. By setting the first recess bottom portion 131 and the second recess bottom portion 231 to be planar structures, the thickness of the maximum thinned regions of the first plate 10 and the second plate 20 can be further reduced, so as to reduce the range or area of the maximum thinned regions of the first plate 10 and the second plate 20, thereby ensuring that the maximum thinned range of the first plate 10 and the second plate 20 is reliably covered during the assembly process of the first plate 10 and the second plate 20, thus improving the strength and corrosion resistance of the heat exchanger.

Figure 6:
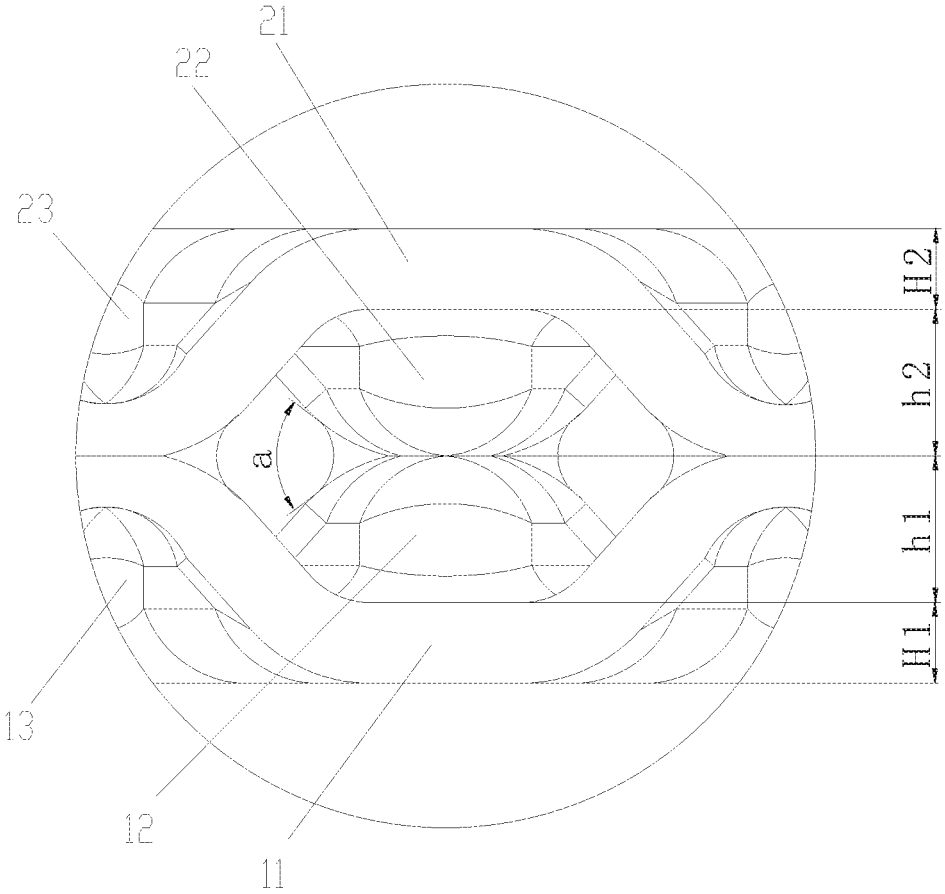
FIG. 6 is a partial enlarged schematic view showing a mounting structure of the first plate and the second plate of the heat exchanger according to the present application.

As shown in FIG. 6, in some embodiments, the first protrusion top portion 121 and the second protrusion top portion 221 are fixed by welding, and the first protrusion side portion 122 is not in contact with the second protrusion side portion 221. An angle between a tangent of the first protrusion side portion 122 at an outer edge of the fixed region and a tangent of the second protrusion side portion 222 at the outer edge of the fixed region is represented as "a", where "a" is equal to or less than 120 degrees. By controlling the angle a formed by the first protrusion side portion 122 and the first protrusion side portion 222 closer to the fixed region, the regions around the first protrusion top portion 121 and the second protrusion top portion 221 are brought as close as possible so that the composite layer at the first protrusion top portion 121 and the second protrusion top portion 221 can be easily adsorbed, so that the composite layer wraps the first protrusion top portion 121 and the second protrusion top portion 221 here and wraps the maximum thinned regions of the first plate 10 and the second plate 20 to improve the strength of the heat exchanger. As shown in FIG. 6, the first protrusion side portion 122 and the second protrusion side portion 222 are of arc-shaped structures. In some embodiments, as shown in FIG. 15 and FIG. 16, the first protrusion side portion 122 and/or the second protrusion side portion 222 may be of planar structures or the like.

The heat exchange according to the present application is described in detail hereinbefore. The principle and the embodiments of the present application are illustrated herein by specific examples. The above description of embodiments is only intended to help the understanding of the core idea of the present application. It should be noted that, for those skilled in the art, many modifications and improvements may be made to the present application without departing from the principle of the present application, and these modifications and improvements are also deemed to fall into the protection scope of the present application defined by the claims.

The invention claimed is:

1. A heat exchanger, comprising a first plate and a second plate that are arranged in a stacked manner, wherein the first plate comprises a first base plate and first protrusions protruding from the first base plate, and the second plate comprises a second base plate and second protrusions protruding from the second base plate;

each of the first protrusions comprises a first protrusion top portion and a first protrusion side portion arranged around the first protrusion top portion, wherein a thickness of the first plate throughout the first protrusion top portion is smaller than a thickness of the first plate throughout the first protrusion side portion; each of the second protrusions comprises a second protrusion top portion and a second protrusion side portion arranged around the second protrusion top portion, wherein a thickness of the second plate throughout the second protrusion top portion is smaller than a thickness of the second plate throughout the second protrusion side portion, and the first protrusion top portion is fixedly connected to the second protrusion top portion; and the first base plate has a thickness of H1, the first protrusion has a height of h1, wherein $0.2 \leq H1/h1 \leq 1$; and/or the second base plate has a thickness of H2, the second protrusion has a height of h2, wherein $0.2 \leq H2/h2 \leq 1$; wherein the first protrusion top portion is of an arc surface structure, and the second protrusion top portion is of an arc surface structure, wherein a first recess bottom portion and a first recess side portion arranged around the first recess bottom portion are provided at one side, facing away from the second plate, of the first protrusion; a second recess bottom portion and a second recess side portion arranged around the second recess bottom portion are provided at one side, facing away from the first plate, of the second protrusion; and wherein the first recess bottom portion is of a planar structure, and/or the second recess bottom portion is of a planar structure.

2. The heat exchanger according to claim 1, wherein an orthographic projection area of a fixed region, at which the first protrusion top portion and the second protrusion top portion are fixed to each other, on a plane in which the first base plate is located is represented as "s";

an orthographic projection area of the first protrusion on the plane in which the first base plate is located is represented as "s1", wherein $2.5 \leq (s+s1)/h1 \leq 8$; and/or an orthographic projection area of the second protrusion on a plane in which the second base plate is located is represented as "s2", wherein $2.5 \leq (s+s2)/h2 \leq 8$.

3. The heat exchanger according to claim 1, wherein the first plate and the second plate each is an aluminum alloy plate; and wherein one side, facing the second protrusion, of the first plate is provided with a composite layer;

and/or one side, facing the first protrusion, of the second plate is provided with a composite layer; and the first protrusion top portion and the second protrusion top portion are fixed to each other by welding.

4. The heat exchanger according to claim 3, wherein the composite layer located at the first protrusion top portion and/or the composite layer located at the second protrusion top portion form a fixed region by welding, wherein for the composite layer located in the fixed region, a thickness of part of the composite layer away from a center of the fixed region is greater than that of another part of the composite layer closer to the center of the fixed region.

5. The heat exchanger according to claim 1, wherein the first plate further comprises a plurality of third protrusions protruding away from the second plate, and third recesses are formed at one side, facing the second plate, of the plurality of third protrusions, respectively; and the second plate further comprises a plurality of fourth protrusions protruding away from the first plate, and fourth recesses are formed at one side, facing the first plate, of the plurality of fourth protrusions, respectively; and wherein in a length direction of the heat exchanger, the first protrusions and the third recesses are alternately arranged, and the second protrusions and the fourth recesses are alternately arranged.

6. A heat exchanger, comprising a first plate and a second plate that are arranged in a stacked manner, wherein the first plate comprises a first base plate and first protrusions protruding from the first base plate, and the second plate comprises a second base plate and second protrusions protruding from the second base plate;

each of the first protrusions comprises a first protrusion top portion and a first protrusion side portion arranged around the first protrusion top portion, wherein a thickness of the first plate throughout the first protrusion top portion is smaller than a thickness of the first plate throughout the first protrusion side portion; each of the second protrusions comprises a second protrusion top portion and a second protrusion side portion arranged around the second protrusion top portion, wherein a thickness of the second plate throughout the second protrusion top portion is smaller than a thickness of the second plate throughout the second protrusion side portion, and the first protrusion top portion is fixedly connected to the second protrusion top portion; and the first base plate has a thickness of H1, the first protrusion has a height of h1, wherein $0.2 \leq H1/h1 \leq 1$; and/or the second base plate has a thickness of H2, the second protrusion has a height of h2, wherein $0.2 \leq H2/h2 \leq 1$; wherein the first protrusion top portion is of an arc surface structure, and the second protrusion top portion is of an arc surface structure, wherein a first recess bottom portion and a first recess side portion arranged around the first recess bottom portion are provided at one side, facing away from the second plate, of the first protrusion; a second recess bottom portion and a second recess side portion arranged around the second recess bottom portion are provided at one side, facing away from the first plate, of the second protrusion; and wherein a curvature radius of the first recess bottom portion is smaller than that of the first recess side portion, and/or a curvature radius of the second recess bottom portion is smaller than that of the second recess side portion.

7. The heat exchanger according to claim 6, wherein an orthographic projection area of a fixed region, at which the first protrusion top portion and the second protrusion top portion are fixed to each other, on a plane in which the first base plate is located is represented as "s";

an orthographic projection area of the first protrusion on the plane in which the first base plate is located is represented as "s1", wherein $2.5 \leq (s+s1)/h1 \leq 8$; and/or an orthographic projection area of the second protrusion on a plane in which the second base plate is located is represented as "s2", wherein $2.5 \leq (s+s2)/h2 \leq 8$.

8. The heat exchanger according to claim 6, wherein the first plate and the second plate each is an aluminum alloy plate; and wherein one side, facing the second protrusion, of the first plate is provided with a composite layer;

and/or one side, facing the first protrusion, of the second plate is provided with a composite layer; and the first protrusion top portion and the second protrusion top portion are fixed to each other by welding.

9. The heat exchanger according to claim 8, wherein the composite layer located at the first protrusion top portion and/or the composite layer located at the second protrusion top portion form a fixed region by welding, wherein for the composite layer located in the fixed region, a thickness of part of the composite layer away from a center of the fixed region is greater than that of another part of the composite layer closer to the center of the fixed region.

10. The heat exchanger according to claim 6, wherein the first plate further comprises a plurality of third protrusions protruding away from the second plate, and third recesses are formed at one side, facing the second plate, of the plurality of third protrusions, respectively; and the second plate further comprises a plurality of fourth protrusions protruding away from the first plate, and fourth recesses are formed at one side, facing the first plate, of the plurality of fourth protrusions, respectively; and wherein in a length direction of the heat exchanger, the first protrusions and the third recesses are alternately arranged, and the second protrusions and the fourth recesses are alternately arranged.

11. A heat exchanger, comprising a first plate and a second plate that are arranged in a stacked manner, wherein the first plate comprises a first base plate and first protrusions protruding from the first base plate, and the second plate comprises a second base plate and second protrusions protruding from the second base plate;

each of the first protrusions comprises a first protrusion top portion and a first protrusion side portion arranged around the first protrusion top portion, wherein a thickness of the first plate throughout the first protrusion top portion is smaller than a thickness of the first plate throughout the first protrusion side portion; each of the second protrusions comprises a second protrusion top portion and a second protrusion side portion arranged around the second protrusion top portion, wherein a thickness of the second plate throughout the second protrusion top portion is smaller than a thickness of the second plate throughout the second protrusion side portion, and the first protrusion top portion is fixedly connected to the second protrusion top portion; and the first base plate has a thickness of H1, the first protrusion has a height of h1, wherein $0.2 \leq H1/h1 \leq 1$; and/or the second base plate has a thickness of H2, the second protrusion has a height of h2, wherein $0.2 \leq H2/h2 \leq 1$; wherein the first plate and the second plate each is an aluminum alloy plate; and wherein one side, facing the second protrusion, of the first plate is provided with a composite layer; and/or one side, facing the first protrusion, of the second plate is provided with a composite layer;

the first protrusion top portion and the second protrusion top portion are fixed to each other by welding; and the composite layer located at the first protrusion top portion and/or the composite layer located at the second protrusion top portion form a fixed region by welding; the first protrusion side portion is not in contact with the second protrusion side portion; and an angle between a tangent of the first protrusion side portion at an outer edge of the fixed region and a tangent of the second protrusion side portion at the outer edge of the fixed region is represented as "a", wherein "a" is equal to or less than 120 degrees.

12. The heat exchanger according to claim 11, wherein an orthographic projection area of the fixed region on a plane in which the first base plate is located is represented as "s";

an orthographic projection area of the first protrusion on the plane in which the first base plate is located is represented as "s1", wherein $2.5 \leq (s+s1)/h1 \leq 8$; and/or an orthographic projection area of the second protrusion on a plane in which the second base plate is located is represented as "s2", wherein $2.5 \leq (s+s2)/h2 \leq 8$.

13. The heat exchanger according to claim 11, wherein the first protrusion top portion is provided with a first planar portion facing the second protrusion, the second protrusion top portion is provided with a second planar portion facing the first protrusion, wherein the first planar portion is in contact with the second planar portion.

14. The heat exchanger according to claim 13, wherein a first recess bottom portion and a first recess side portion arranged around the first recess bottom portion are provided at one side, facing away from the second plate, of the first protrusion; a second recess bottom portion and a second recess side portion arranged around the second recess bottom portion are provided at one side, facing away from the first plate, of the second protrusion; and wherein a curvature radius of the first recess bottom portion is smaller than that of the first recess side portion, and/or a curvature radius of the second recess bottom portion is smaller than that of the second recess side portion.

15. The heat exchanger according to claim 11, wherein the first plate further comprises a plurality of third protrusions protruding away from the second plate, and third recesses are formed at one side, facing the second plate, of the plurality of third protrusions, respectively; and the second plate further comprises a plurality of fourth protrusions protruding away from the first plate, and fourth recesses are formed at one side, facing the first plate, of the plurality of fourth protrusions, respectively; and wherein in a length direction of the heat exchanger, the first protrusions and the third recesses are alternately arranged, and the second protrusions and the fourth recesses are alternately arranged.

16. A heat exchanger, comprising a first plate and a second plate that are arranged in a stacked manner, wherein the first plate comprises a first base plate and first protrusions protruding from the first base plate, and the second plate comprises a second base plate and second protrusions protruding from the second base plate;

each of the first protrusions comprises a first protrusion top portion and a first protrusion side portion arranged around the first protrusion top portion, wherein a thickness of the first plate throughout the first protrusion top portion is smaller than a thickness of the first plate throughout the first protrusion side portion; each of the second protrusions comprises a second protrusion top portion and a second protrusion side portion arranged around the second protrusion top portion, wherein a thickness of the second plate throughout the second protrusion top portion is smaller than a thickness of the second plate throughout the second protrusion side portion, and the first protrusion top portion is fixedly connected to the second protrusion top portion; and the first base plate has a thickness of H1, the first protrusion has a height of h1, wherein $0.2 \leq H1/h1 \leq 1$; and/or the second base plate has a thickness of H2, the second protrusion has a height of h2, wherein $0.2 \leq H2/h2 \leq 1$; wherein the first plate and the second plate each is an aluminum alloy plate; and wherein one side, facing the second protrusion, of the first plate is provided with a composite layer;

and/or one side, facing the first protrusion, of the second plate is provided with a composite layer;

the first protrusion top portion and the second protrusion top portion are fixed to each other by welding; and the composite layer located at the first protrusion top portion and/or the composite layer located at the second protrusion top portion form a fixed region by welding, wherein for the composite layer located in the fixed region, a thickness of part of the composite layer away from a center of the fixed region is greater than that of another part of the composite layer closer to the center of the fixed region.

17. The heat exchanger according to claim 16, wherein an orthographic projection area of the fixed region on a plane in which the first base plate is located is represented as "s";

an orthographic projection area of the first protrusion on the plane in which the first base plate is located is represented as "s1", wherein $2.5 \leq (s+s1)/h1 \leq 8$; and/or an orthographic projection area of the second protrusion on a plane in which the second base plate is located is represented as "s2", wherein $2.5 \leq (s+s2)/h2 \leq 8$.

18. The heat exchanger according to claim 16, wherein the first protrusion top portion is provided with a first planar portion facing the second protrusion, the second protrusion top portion is provided with a second planar portion facing the first protrusion, wherein the first planar portion is in contact with the second planar portion.

19. The heat exchanger according to claim 18, wherein a first recess bottom portion and a first recess side portion arranged around the first recess bottom portion are provided at one side, facing away from the second plate, of the first protrusion; a second recess bottom portion and a second recess side portion arranged around the second recess bottom portion are provided at one side, facing away from the first plate, of the second protrusion; and wherein a curvature radius of the first recess bottom portion is smaller than that of the first recess side portion, and/or a curvature radius of the second recess bottom portion is smaller than that of the second recess side portion.

20. The heat exchanger according to claim 16, wherein the first plate further comprises a plurality of third protrusions protruding away from the second plate, and third recesses are formed at one side, facing the second plate, of the plurality of third protrusions, respectively; and the second plate further comprises a plurality of fourth protrusions protruding away from the first plate, and fourth recesses are formed at one side, facing the first plate, of the plurality of fourth protrusions, respectively; and wherein in a length direction of the heat exchanger, the first protrusions and the third recesses are alternately arranged, and the second protrusions and the fourth recesses are alternately arranged.

* * * * *